US008663079B2

(12) United States Patent
Zeitz

(10) Patent No.: US 8,663,079 B2
(45) Date of Patent: Mar. 4, 2014

(54) DEFLECTION ROLLER

(75) Inventor: Günter Zeitz, Hammelburg (DE)

(73) Assignee: Saurer Components GmbH, Fellbach (DE)

( * ) Notice: Subject to any disclaimer, the term of this patent is extended or adjusted under 35 U.S.C. 154(b) by 532 days.

(21) Appl. No.: 13/047,308

(22) Filed: Mar. 14, 2011

(65) Prior Publication Data

US 2011/0220757 A1 Sep. 15, 2011

(30) Foreign Application Priority Data

Mar. 15, 2010 (DE) ..... 10 2010 011 401

(51) Int. Cl.
*B65H 20/02* (2006.01)

(52) U.S. Cl.
USPC ..... 492/50; 492/59; 492/56

(58) Field of Classification Search
USPC ..... 492/52, 56, 39, 50, 53, 59
See application file for complete search history.

(56) References Cited

U.S. PATENT DOCUMENTS

| | | | | |
|---|---|---|---|---|
| 5,111,566 | A * | 5/1992 | Schnyder et al. | 492/7 |
| 5,146,664 | A * | 9/1992 | Biondetti | 492/7 |
| 5,244,448 | A * | 9/1993 | Niskanen et al. | 492/5 |
| 5,324,248 | A | 6/1994 | Quigley | |
| 5,834,116 | A * | 11/1998 | Sawa et al. | 428/375 |
| 6,027,673 | A | 2/2000 | Speckman | |
| 6,623,601 | B2 * | 9/2003 | Graf et al. | 162/272 |
| 6,935,993 | B2 * | 8/2005 | Grabscheid et al. | 492/20 |
| 6,982,116 | B1 | 1/2006 | Passman et al. | |
| 7,014,604 | B2 * | 3/2006 | Vergara | 492/56 |
| 7,147,596 | B2 | 12/2006 | Reynolds | |
| 7,162,953 | B2 * | 1/2007 | Schnyder et al. | 100/155 R |
| 7,251,437 | B2 | 7/2007 | Tamoto et al. | |
| 7,416,823 | B2 * | 8/2008 | Yanagawa et al. | 430/58.7 |
| 7,608,306 | B2 * | 10/2009 | Hasskerl et al. | 427/487 |
| 2003/0045412 | A1 | 3/2003 | Schulz et al. | |
| 2007/0098884 | A1 * | 5/2007 | Hasskerl et al. | 427/180 |

FOREIGN PATENT DOCUMENTS

DE 10 2007 000 505 4/2009

* cited by examiner

*Primary Examiner* — David Bryant
*Assistant Examiner* — Jason L Vaughan
(74) *Attorney, Agent, or Firm* — Alston & Bird LLP

(57) ABSTRACT

A deflection roller for guiding a nonwoven web is described, which deflection roller comprises a guide jacket, which is mounted so as to be rotatable and on the circumferential surface of which the nonwoven web can be guided so as to be in contact therewith. In order to achieve a smooth-running and low-inertia guide jacket, the jacket material is formed by a carbon fiber-reinforced plastic. For preventing any interaction between the nonwoven web to be guided and the guide jacket, the circumferential surface is formed, as suggested by the invention, by a wear-resistant layer that is applied to the jacket material and that has an electrical conductivity.

5 Claims, 2 Drawing Sheets

DEFLECTION ROLLER

CROSS-REFERENCE TO RELATED APPLICATIONS

The present application claims priority from German Patent Application No. 10 2010 011 401.4, filed Mar. 15, 2010.

FIELD OF THE INVENTION

The invention relates to a deflection roller for guiding a nonwoven web.

BACKGROUND OF THE INVENTION

In the manufacturing process of linear nonwoven webs, for example, for sanitary products such as diapers, sanitary napkins etc., it is generally known that the nonwoven webs are guided between the individual treatment stages by means of deflection rollers. The deflection rollers are predominantly operated without a drive system so that the propulsion energy must be generated by the nonwoven web guided on the circumference of the deflection rollers. In this connection, it is necessary to prevent a slip between the nonwoven web and a guide jacket of the deflection roller depending on the product. Friction conditions of such type between a guide jacket and a nonwoven web result in an undesirable electrostatic charge that can lead to non-uniform fiber distributions, particularly in the case of the nonwoven web, and a bursting of the sliver. Therefore it is also necessary to prevent relative movements between the guide jacket of the deflection roller and the nonwoven web when stopping the manufacturing process. Deflection rollers, the guide jackets of which have a high moment of inertia are thus not suitable. A tendency of the deflection roller to coast can directly result in damage to the web of material.

In the search for suitable embodiments of the guide jacket of a deflection roller, a roller covering made of a fiber-reinforced plastic is revealed in DE 10 2007 000 505 A1. Relatively light guide jackets having low moments of inertia can thus be achieved. However, such guide jackets made of fiber-reinforced plastics necessitate a subsequent machining process in order to prevent signs of unbalance on the deflection roller when used at high rotational speeds of up to 6,000 rpm. However, the machined surface of the guide jacket poses the risk of individual fiber particles breaking loose from the guide jacket and mixing with the nonwoven web. Such type of foreign material is not permissible in the production of sanitary products.

It is an object of the invention to provide a deflection roller of the generic kind that enables a more secure and gentle guidance of a nonwoven web by means of a low-mass guide jacket.

SUMMARY OF VARIOUS EMBODIMENTS

This object is achieved according to the invention in that the circumferential surface is formed by a wear-resistant layer that is applied to the jacket material and that has an electrical conductivity.

Preferred developments of the invention are defined by the features and combinations of features of the respective subclaims.

The invention is characterized in that the circumferential surface coming directly in contact with the nonwoven web is made of a material that has high abrasion resistance and applies sufficient adhesion to the nonwoven web in order to enable the deflection roller to be self-propelled. In particular, the electrical conductivity of the wear-resistant layer can advantageously prevent static charges from appearing on the nonwoven web.

In order to minimize the moment of inertia of the guide jacket on the one hand and achieve high resistance to abrasion and wear on the other, a development of the invention has proved particularly successful in which the wear-resistant layer is formed by a coating comprising a hybrid polymer and in which the electrical conductivity of the coating is produced by a mixed oxide indexed in the hybrid polymer. It has thus been observed that the molecular structural units produced by the hybrid polymers link optimally to the fiber-reinforced plastic and form a surface texture of the wear-resistant layer that is optimum for guiding the nonwoven web. Moreover, it is possible to apply the wear-resistant layer in the form of a coating with high precision of layer thickness after a machining operation of the guide jacket. Thus the rotationally symmetrical distribution of mass in the guide jacket that was determined beforehand by means of a machining operation is not affected adversely. Furthermore, the indexing of the mixed oxides ensures a uniform distribution of the properties for producing an electrical conductivity so that a fiber web guided on the guide jacket experiences uniform discharges over the entire width of material.

The electrical conductivity can be achieved particularly by means of an indium tin-oxide powder. Indium tin-oxide powder is generally used in electronic components in order to prevent electrostatic charges. The combination with a hybrid polymer is thus advantageous in order to enable a joint application by means of a coating process on the one hand and ensure the required surface properties of the deflection roller on the other.

Due to the good mechanical stability, the thickness of the wear-resistant layer can be in the range of 5 to 20 μm. This ensures the service life of the deflection rollers that is required in manufacturing processes.

In order to also achieve sufficient stability when nonwoven webs of greater widths are guided on the deflection roller, one development of the invention is particularly advantageous in which the jacket material has a proportion of at least 40% carbon fibers that form a wound fabric. Fabric structures of this type comprising large proportions of carbon fibers thus enable increased stability of the guide jacket even in the case of freely cantilevered guide jackets.

In order to further reduce inertia, the guide jacket is preferably cylindrically hollow and is mounted so as to rotate over two bar-shaped hubs on a support axle. Thus it is also possible to securely guide nonwoven webs that are very sensitive to traction with low friction on the circumference of the deflection roller.

The support axle can be mounted on two ends inside a machine frame. However, provision is made to attach the support axle with one end thereof to a holder that is supported by a machine frame and that extends with a holding end thereof into an end opening of the guide jacket. The bearing point formed in the interior of the guide jacket can thus also be shielded outwardly from the ambience.

The opposite end opening of the guide jacket is preferably closed by means of a cover. The bearing points are thus shielded from the ambience and environmental influence.

The smooth-running and low-inertia design of the guide jacket also renders the deflection roller of the invention suitable for other applications in order to guide particularly webs of material having low basis weights.

BRIEF DESCRIPTION OF THE SEVERAL VIEWS OF THE DRAWINGS

The invention is explained in more detail below with reference to an exemplary embodiment of the deflection roller of the invention. For this purpose, FIG. 1 diagrammatically represents a cross-sectional view of an exemplary embodiment of the deflection roller of the invention.

DETAILED DESCRIPTION

Figure 1:
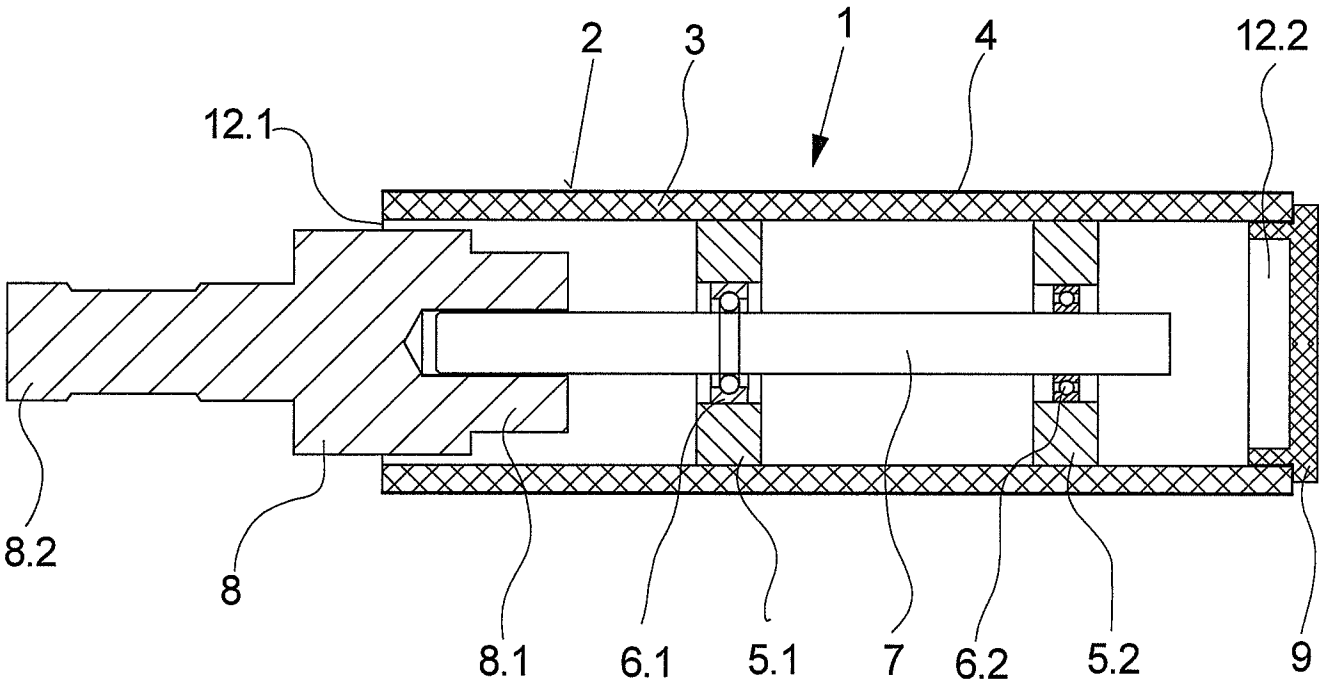

The exemplary embodiment of the deflection roller of the invention shown in FIG. 1 comprises a guide jacket 1 that is mounted so as to be rotatable. The guide jacket 1 is cylindrically hollow and is permanently connected by means of two hubs 5.1 and 5.2 disposed at a distance from each other in the interior of the guide jacket 1. The hub 5.1 is mounted by means of the bearing 6.1 on the circumference of a support axle 7, and the hub 5.2 is likewise mounted by means of a bearing 6.2 on the support axle 7. The bearings 6.1 and 6.2 in this exemplary embodiment are braced against each other so that the guide jacket 1 is held securely on the circumference of the support axle 7. The bearing 1 [sic: 6.1] is mounted by means of its rolling body directly in a raceway of the support axle 7. In contrast, the bearing 6.2 is formed by a commercially available rolling bearing.

The support axle 7 is permanently connected to a holder 8 so as to project therefrom. For this purpose, the holder 8 comprises a holding end 8.1 that extends into one of the end openings 12.1 of the guide jacket 1. A small running gap is formed between the holding end 8.1 of the holder 8 and the guide jacket 1 so that the bearing 6.1 is shielded from the ambience. The holder 8 comprises an opposite mounting end 8.2 that serves for securing the deflection roller on a machine frame.

On its opposite end opening 12.2, the guide jacket 1 supports a cover 9 that seals the bearing 6.2 from the ambience.

Figure 2:
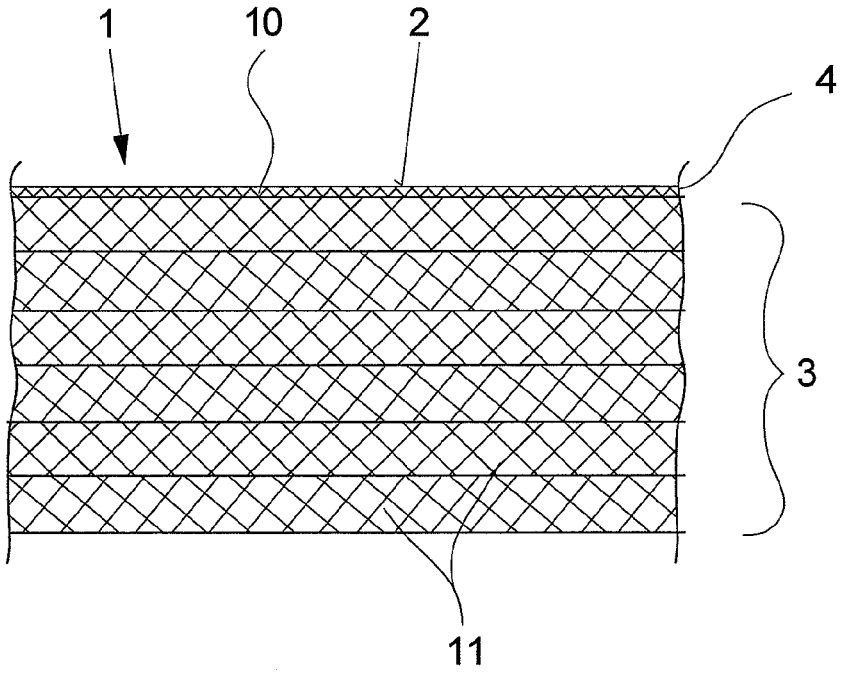
FIG. 2 shows a section of the guide jacket of the deflection roller shown in FIG. 1.

In addition to FIG. 1, reference is likewise made to FIG. 2 for describing the guide jacket 1. FIG. 2 diagrammatically represents a section of the guide jacket 1. The guide jacket 1 comprises a material 3 made of a carbon fiber-reinforced plastic.

As shown in FIG. 2, the carbon fibers in the plastic form a fabric 11 that is wound in a plurality of layers. Preferably an epoxy resin is used as the plastic for this purpose. The stability of the guide jacket is achieved by means of a minimum proportion of the carbon fibers of 40%.

Since semi-finished cylindrically hollow guide jackets of such type are not producible with a rotational symmetry that is sufficient for high rotational speeds, the circumferential surface is often machined which results in revealing the fiber structure. In order to prevent individual particles of the carbon fibers from breaking loose from the guide jacket, the circumferential surface 2 of the guide jacket 1 is formed by a wear-resistant layer 4. The wear-resistant layer 4 has an electrical conductivity so that it is possible to prevent electrostatic charges when guiding synthetic fiber webs on the circumferential surface 2. As represented diagrammatically in FIG. 2, the wear-resistant layer 4 is formed by a coating 10 comprising a hybrid polymer. Thus, on the one hand, an intensive surface compound is achieved with the carbon fiber-reinforced plastic and, on the other hand, the inertia properties of the guide jacket that are determined by the carbon fiber-reinforced plastic are substantially unaltered. In this respect, the combination of a carbon fiber-reinforced plastic and a hybrid-polymer coating is particularly advantageous in order to meet the demands made on deflection rollers for the guidance of nonwoven webs. The electrical conductivity of the coating is produced by means of a mixed oxide that is indexed in the hybrid polymer. Such type of mixed oxides are usually dispersed in the hybrid polymer in the form of powders so that a very uniform distribution can be achieved during the application of the coating by means of a spray coat method so that the properties for electrical conductivity are produced uniformly on all regions of the circumferential surface of the guide jacket. Indium tin-oxide powders that are generally used in the field of electrical engineering for the prevention of electrostatic charges have proved successful as indexed mixed oxides. Moreover, powders of such type do not adversely affect the molecular structure for generating the mechanical stability of the guide jacket and merely produce the electrical conductivity of the coating.

Another essential advantage of the hybrid-polymer coating 10 is that relatively thin wear-resistant layers 4 ranging from 5 to 20 μm can be produced on the guide jacket 1.

The deflection roller of the invention thus comprises a very low-mass smooth-running guide jacket that can be driven easily by the nonwoven web guided on the circumferential surface and that also does not exhibit a tendency to coast when the manufacturing process is stopped. In this connection, the exemplary embodiment shown in FIG. 1 is preferably used without a drive system in a manufacturing process. However, it is basically also possible to combine the guide jacket 1 with a drive system in special applications.

The exemplary embodiment of the deflection roller of the invention shown in FIG. 1 merely represents one design option of mounting the guide jacket of the deflection roller. In principle, the components for supporting and mounting the guide jacket can be constructively replaced with similar designs. Thus, for example, an annular gap formed between a holder and one end of the guide jacket can also be closed by means of an additional cover.

The use of the deflection roller of the invention is possible at high rotational speeds of more than 6,000 rpm as a result of the smooth movement and high rotational symmetry of the guide jacket. Process speeds ranging from 700 to 800 m/min. can thus be achieved with a relatively small outer diameter of the guide jackets which results in an appropriately low cost of materials. The deflection roller of the invention is thus particularly suitable for applications in the textile industry.

That which is claimed is:

1. A deflection roller for guiding a nonwoven web, said deflection roller comprising:

a cylindrically hollow guide jacket formed of a carbon fiber-reinforced plastic;

wherein the guide jacket is mounted on two bearings such that the guide jacket rotates relative to a support axle, the support axle extending through the center of the guide jacket;

wherein the support axle includes two hubs, and wherein one of the two bearings is mounted on each of the two hubs;

wherein the guide jacket is supported by the support axle and capable of rotating relative to the support axle via the two bearings;

wherein the guide jacket is rotated relative to the support axle by contact with the nonwoven web on an outer circumferential surface of the guide jacket;

wherein the outer circumferential surface of the guide jacket is formed by a wear-resistant layer that is applied to the guide jacket;

wherein the wear-resistant layer is electrically conductive;

wherein the wear-resistant layer is formed of an electrically conductive coating comprising a hybrid polymer, and the electrical conductivity of the coating being provided by a mixed oxide included in the hybrid polymer; and wherein the mixed oxide includes indium tin-oxide powder.

2. The deflection roller of claim 1, wherein the wear-resistant layer has a thickness ranging from 5 to 20 μm.

3. The deflection roller of claim 1, wherein the carbon fiber-reinforced plastic includes at least 40% carbon fibers, and wherein the carbon fibers that form a wound fabric.

4. The deflection roller as defined in claim 1, wherein the support axle is mounted on a holder;

wherein the support axle projects from the holder;

wherein the holder extends into an end opening of the guide jacket; and wherein the holder includes a holding end.

5. The deflection roller of claim 4, wherein the guide jacket includes a second opening opposite the opening into which the holder extends; and wherein the second opening of the guide jacket is closed by a cover.

* * * * *

UNITED STATES PATENT AND TRADEMARK OFFICE

CERTIFICATE OF CORRECTION

PATENT NO. : 8,663,079 B2
APPLICATION NO. : 13/047308
DATED : March 4, 2014
INVENTOR(S) : Zeitz It is certified that error appears in the above-identified patent and that said Letters Patent is hereby corrected as shown below:

In the claims:

Column 5,
Lines 16 and 17, "carbon fibers that form a wound fabric." should read --carbon fibers form a wound fabric.--.

Signed and Sealed this
Twenty-fourth Day of June, 2014

Michelle K. Lee

Michelle K. Lee
*Deputy Director of the United States Patent and Trademark Office*